United States Patent [19]

Mulford

[11] Patent Number: 4,658,557

[45] Date of Patent: Apr. 21, 1987

[54] BUILDING WALL CONSTRUCTION

[76] Inventor: Cass E. Mulford, Rd. 3, Canastota, N.Y. 13032

[21] Appl. No.: 682,169

[22] Filed: Dec. 17, 1984

Related U.S. Application Data

[63] Continuation-in-part of Ser. No. 371,905, Apr. 26, 1982, Pat. No. 4,488,390.

[51] Int. Cl.[4] ..... E04B 2/00

[52] U.S. Cl. ..... 52/407; 52/481

[58] Field of Search ..... 52/407, 807, 729, 404, 52/730, 406, 481, 729

[56] References Cited

U.S. PATENT DOCUMENTS

| | | | |
|---|---|---|---|
| 1,559,134 | 10/1925 | Utzman | 52/376 |
| 2,099,470 | 11/1937 | Coddington | 52/376 |
| 2,191,804 | 2/1940 | O'Malley | 52/408 |
| 2,299,908 | 10/1942 | Leash | 52/407 |
| 2,397,345 | 3/1946 | Gilleland | 52/407 |
| 2,444,133 | 6/1948 | Groat | 52/481 |
| 3,488,904 | 1/1970 | Schneller | 52/481 |
| 4,142,471 | 3/1979 | Mustoe | 108/51.1 |
| 4,224,774 | 9/1980 | Petersen | 52/730 |
| 4,329,827 | 5/1982 | Thorn | 52/809 |

*Primary Examiner*—John E. Murtagh

*Attorney, Agent, or Firm*—Charles S. McGuire

[57] ABSTRACT

A wall construction for both exterior and interior walls which is particularly adapted for fire protection, minimizing the possibility of burn-through from one side to the other of a construction utilizing wood portions. The basic structural member which forms the studs, top plates and sills or bottom plates, includes a pair of elongated, spaced wooden members joined by a web structure of fire-rated gypsum board. Preferably, in addition to the sheathing layers on each side of the studs, an interior panel is provided, separating the space between the sheathing layers into two separate spaces, one of which may be filled with fireproof insulation and the other utilized for plumbing, electrical lines and fixtures, etc. In another embodiment, particularly intended as an interior, party wall, a pair of panel members are provided, containing a layer of insulation therebetween for sound dampening purposes. The sheathing and interior panels, as well as the web members, are all of fire-rated material such as gypsum board.

7 Claims, 8 Drawing Figures

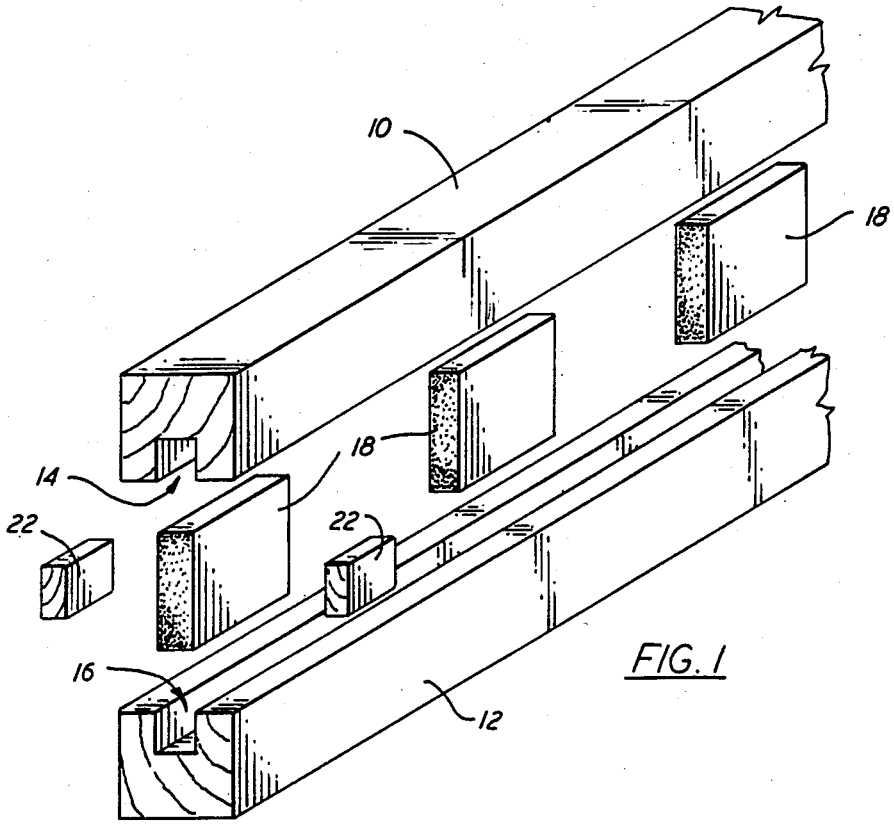
FIG. 1
FIG. 2
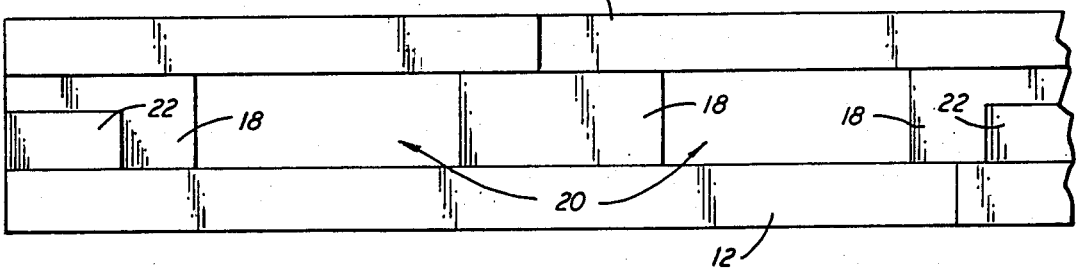
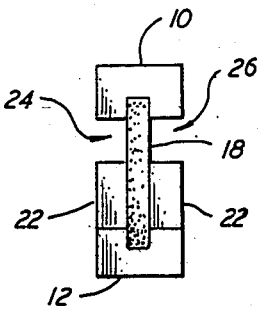
FIG. 3
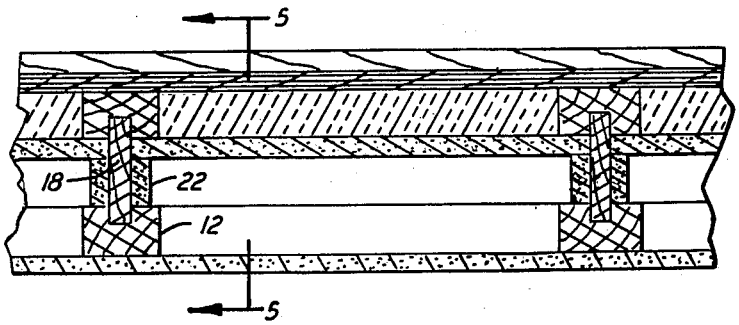
FIG. 4

BUILDING WALL CONSTRUCTION

REFERENCE TO RELATED APPLICATION

This is a continuation-in-part of application Ser. No. 371,905, filed Apr. 26, 1982, of the same inventor, now U.S. Pat. No. 4,488,390, issued Dec. 18, 1984.

BACKGROUND OF THE INVENTION

The present invention relates to building wall constructions and, more particularly to wall structures incorporating novel structural members and features providing both fire protection and sound insulation qualities.

In aforementioned U.S. Pat. No. 4,488,390 a building wall is disclosed which includes web-type studs having a pair of wooden members secured together in spaced relation by a web member of low density fibre board providing thermal and sound insulating qualities. A panel member, substantially the full height of the studs extends between each pair of studs, providing two separated spaces between the sheathing layers affixed to the outer stud surfaces on both sides. The panel member vertical edges are retained in channels formed for such purpose by spaces members affixed to the surfaces of the web members.

In many wall constructions it is desireable to employ wooden structural members for the many well-known advantages thereof, although it is likewise desireable to have a wall which is not susceptible to rapid burn-through in the event of fire. It is further a desired quality of interior, party walls to provide a relatively high degree of noise isolation on opposite sides, i.e., a "soundproof" wall.

It is a principal object of the present invention to provide a building wall construction employing web-type structural members, thereby obtaining the advantages thereof over solid wood members, as generally pointed out in applicant's aforementioned patent, while also providing a high degree of fire protection.

Another object is to provide a novel wall construction particularly adapted for use as an interior, party wall having a high degree of noise isolation while remaining relatively economical in both fabrication and assembly of the structural members forming the wall.

A further object is to provide a load bearing, web-type structural member for use in wall constructions which provides, depending upon the particular form used, some or all of the following qualities: low weight-to-length ratio, fire protection against burn-through, sound and heat insulation, direct pass through of plumbing and electrical lines, ease of handling, and economy of materials.

Other objects will in part be obvious and will in part appear hereinafter.

SUMMARY OF THE INVENTION

The basic structural member of the invention is of webtype construction wherein a pair of elongated wooden members are joined in spaced relation by one or more web members having marginal edge portions engaged in grooves in the wooden members. In the preferred construction, the web members are of gypsum board or other fire-rated material, and are provided in a spaced plurality along the length of the wooden members, the combined length of the web members being about one-half the length of the wooden members. Such structural members are used as the studs, the top plates and the sills or bottom plates in the wall construction, with sheathing layers covering both sides of the stud wall and also being of fire-rated material.

In one wall construction of the invention, spacer members are affixed to the sides of some or all of the web members to provide a channel open on one side and defined on the other three by portions of the spacer member, the web member and one of the wooden members, A panel member is supported with its vertical edges engaged in the channels of successive studs, thus providing two, separate, enclosed spaced between opposite sides of the panel member and the sheathing layers on each side of the studs. At least one of the spaces is preferably filled with fireproof or fire resistant insulation material. In another wall construction, particularly suited for use as an interior party wall where sound transmission through the wall is to be minimized, two panel members are provided, each spaced from one another and from the adjacent layer of sheathing material, and the space between the panel member is filled with a layer of resilient insulating material which is compressed to some extent between the panel members.

BRIEF DESCRIPTION OF THE DRAWINGS

FIG. 1 is an exploded, perspective view of a preferred embodiment of the basic structural member used in the wall construction of the invention;

FIG. 2 is a front elevational view of the structural member of FIG. 1;

FIG. 3 is an end elevational view thereof;

FIG. 4 is a fragmentary, top plan view, in horizontal section, of a first type of stud wall constructed with the structural members of FIGS. 1–3;

DETAILED DESCRIPTION

Figure 5:
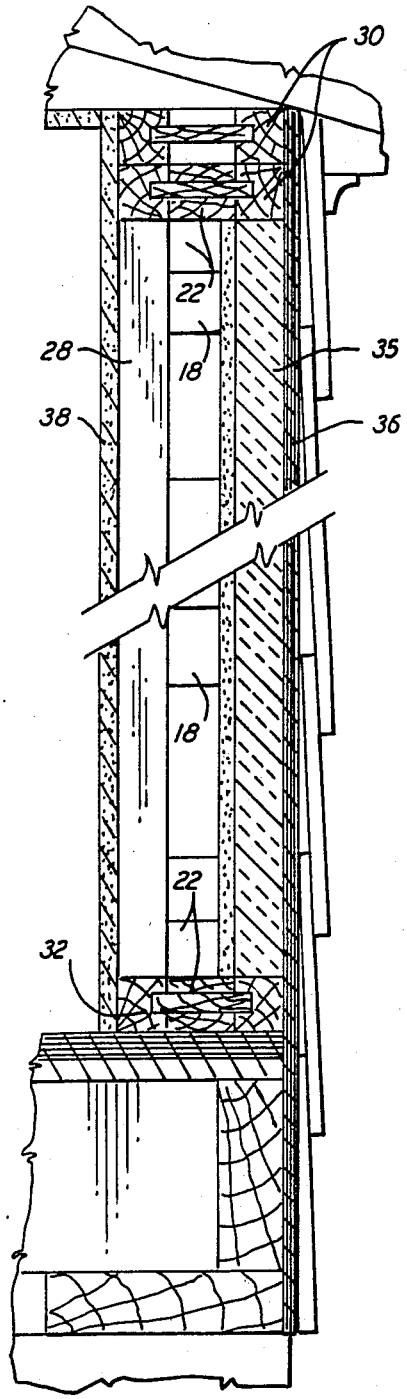
FIG. 5 is a side elevational view of the wall of FIG. 4, in section on the line 5—5 thereof.

Referring now to the drawings, in FIGS. 1–3 is shown a structural member of a type preferred for use in the wall construction of the invention comprising a pair of essentially square, elongated, wooden members 10 and 12, each having a groove 14 and 16, respectively, extending into one face thereof for the full length of the wooden members. A plurality of web members 18 have opposite, marginal edge portions extending into grooves 14 and 16, and firmly secured to wooden members 10 and 12 by interference fit in the grooves, or by a suitable adhesive, or both. Web members 18 are of lesser length than the wooden members and are spaced from one another along the length of grooves 14 and 16, thereby providing open spaces 20 along the length of the structural members, as indicated in FIG. 2.

According to one construction, spacer members 22 are affixed to each side of some or all of web members 18 by screws, nails, adhesive, or friction fit with a panel member described later herein. The spacer members are for the purpose of providing channels 24 and 26 (FIG. 3) open on one side and bounded on the other three sides by portions of wooden member 10, web member 18 and spacer members 22. The composite structural members are used as studs, and as top and bottom plates in the wall construction of the invention. Although the web members may extend the full length of the wooden members, they are preferably shorter and spaced along the length of the wooden members, at least in those structural members to be employed as studs in the wall construction, provided the necessary structural qualities are maintained. The material of web members 18 is a fireproof or fire resistant material such as gypsum board, as are spacer members 22, in order to reduce the likelihood of burn-through of the wall construction.

A wall construction incorporating the structural members of FIGS. 1–3 is shown in FIGS. 4 and 5. The structural members employed as the vertical studs are denoted by reference numeral 28, and those employed as the horizontal top plates and sills or bottom plates by reference numerals 30 and 32, respectively. Studs 28 are nailed in the usual manner to top plates 30 (normally provided in pairs, as shown) and bottom plate 32. Panel members 34, also of fire-rated gypsum board, are positioned between each successive pair of studs 28, being supported by marginal edge portions of the panel members being inserted into channels 24 and 26. It is also to be noted, as earlier mentioned, that spacer members 22 need not be fixedly attached to the web members, but may instead be inserted with a friction fit after panel members 34 are in place. Spacer members 22 are not required on top and bottom plates 30 and 32, but may be provided on one or both sides, extending the full width between the wooden members, in order to abut the top and bottom edges of the panel members. A layer of conventional insulating material 35, such as Fiberglas or RockWool, is applied to one side of panel members 34 and covered by sheathing layer 36, secured to one side of studs 28. Sheathing layer 38 is secured to the opposite side of studs 28 with the space between panel members 34 and sheathing layer 38 left open, as shown, or also filled with insulating material, if desired. Sheathing layers 36 and 38 may also be of gypsum board, or other fire-rated material, although it is of greater importance that the web, spacer and panel members, i.e., all materials between the wooden members, be of such material in order to provide a wall wherein burn-through, i.e., the spreading of fire from one side to the other, is greatly retarded.

Figure 6:
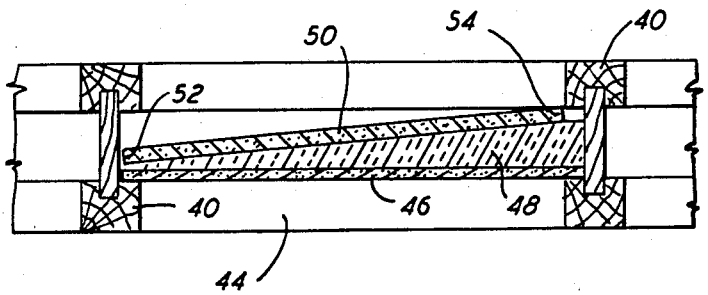
FIGS. 6 and 7 are fragmentary, top plan views, in horizontal section, of a second type of stud wall, constructed with a modified type of structural member, showing two steps in the construction thereof.
Figure 7:
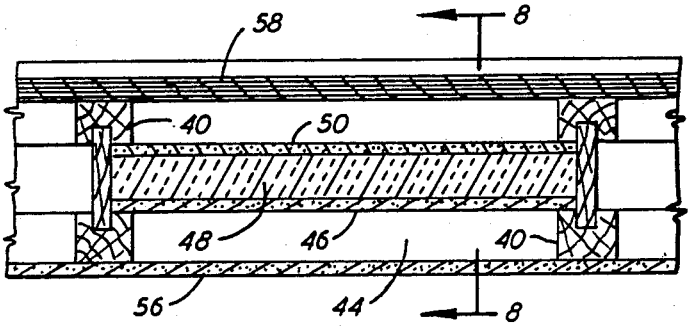
Figure 8:
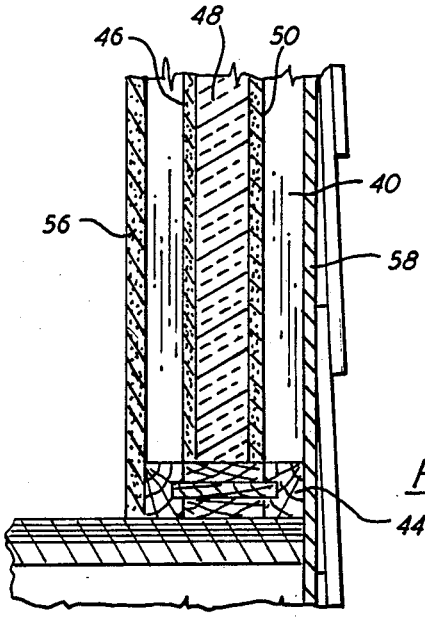
FIG. 8 is a side elevational view of the wall of FIG. 7, in section on the line 8—8 thereof.

Turning now to FIGS. 6–8, another type of fire-retardant wall construction is shown. Spacer members, such as those denoted by reference numeral 22 in the previously described embodiment, are not utilized. The studs and bottom plates are denoted by reference numerals 40 and 44, respectively. After construction of the stud wall by nailing studs 40 to top and bottom plates, panel members 46 are inserted between each successive pair of studs 40 with the vertical, marginal edges of panels 46 against the sides of one of the stud wooden members adjacent the web member. A resilient batt of insulating material 48 is then placed against the inner surface of panel members 46. While holding insulating material 48 in place, panel member 50 is inserted between studs 40 by compressing insulating material 48 along one side with one vertical edge 52 of panel member 50 to allow clearance for the other vertical edge 54 to be inserted behind the wooden member of the next stud 40, as shown in FIG. 6.

When edge 52 of panel member 50 is released, the natural resilience of insulating material 48, and tendency to expand to its original thickness will force edge 54 of panel member 50 against the adjacent surface of the wooden member of stud 40. The original thickness of insulating material 48 is somewhat greater than the distance between panel members 46 and 50, whereby the latter are retained in position by the resilient force applied by the compressed insulting material 48. Sheathing layers 56 and 58 are then affixed to the opposite sides of studs 40 to provide the wall construction as shown in FIGS. 7 and 8 which is particularly well suited, although not limited to, use as an interior, party wall due to the superior sound insulating qualities, as well as the fire retardant features, all of the stud web members, panels 46 and 50, insulating material 48, and sheathing layers 56 and 58 being of fire-rated materials.

Although web member 28 may extend the full length of the wooden members, it is preferred that a plurality of separate segments be positioned in spaced relation, as shown in FIGS. 1 and 2, assuming the structural requirements of a given installation are met. This provides a number of advantages, in addition to the obvious savings in material cost. For example, the weight of a structural member per unit of length is less, making transportation and handling easier and cheaper. The spaces between the web portions may be utilized for passage of plumbing and electrical lines through studs without drilling or otherwise forming openings after installation. Also, gripping and carrying the structural members is facilitated by the spaces between web portions, and conduction of heat and sound through the members is reduced in the areas between web portions. The use of such members is not limited to studs, top plates and sills in wall constructions but may be extended to joists, rafters, etc. as well as roof truss structures as shown, for example, in application Ser. No. 682,163, of the same inventor, filed of even date herewith.

What is claimed is:

1. A building wall construction comprising, in combination:

(a) an elongated top plate;

(b) an elongated bottom plate extending in spaced, horizontal, parallel relation to said top plate;

(c) a plurality of elongated studs arranged in spaced, vertical, parallel relation and affixed at their upper and lower ends to said top and bottom plates, respectively;

(d) each of said studs, top plates and bottom plates comprises a pair of spaced wooden members of equal length having a substantially rectangular groove centrally disposed in one face thereof extending for the entire length of said wooden members, and at least one web member of fire-rated gypsum board having opposite, marginal edge portions secured in said grooves, thereby joining said wooden members in spaced relation, the dimensions and materials of said wooden members and said web member being such that said studs are suited for supporting loads applied at the ends;

(e) sheathing layers affixed to both sides of said stud members and extending vertically between said bottom and top plates, and horizontally between said studs to enclose the space therebetween; and (f) at least one panel member of fire-rated gypsum board extending horizontally between each successive pair of studs parallel to and spaced from each of said sheathing layers, thus providing at least two, separated spaces between said sheathing layers.

2. The invention according to claim 1 wherein at least one of said separated spaces is filled with fire-retardant insulating material.

3. The invention according to claim 2 wherein said panel member extends between the web members of successive studs and has a thickness less than the distance between said wooden members, and further comprising at least one spacer member of fire-rated gypsum board having a width substantially equal to the difference between the thickness of said panel member and the distance between said wooden members, said spacer member being inserted between said panel member and one of said wooden members to retain said panel member in position.

4. A building wall construction comprising, in combination:

(a) an elongated top plate;

(b) an elongated bottom plate extending in spaced, horizontal, parallel relation to said top plate;

(c) a plurality of elongated studs arranged in spaced, vertical, parallel relation and affixed at their upper and lower ends to said top and bottom plates, respectively;

(d) each of said studs, top plates and bottom plates comprises a pair of spaced wooden members of equal length having a substantially rectangular groove centrally disposed in one face thereof extending for the entire length of said wooden members, and at least one web member of fire-rated gypsum board having opposite, marginal edge portions secured in said groove, thereby joining said wooden members in spaced relation, the dimensions and materials of said wooden members and said web member being such that said studs are suited for supporting loads applied at the ends;

(e) sheathing layers affixed to both sides of said stud members and extending vertically between said bottom and top plates, and horizontally between said studs to enclose the space therebetween; and (f) a pair of panel members extending between each successive pair of studs, each of said panel members being of fire-rated gypsum board and spaced both from one another and from each of said sheathing layers, thereby providing two separated spaces between the respective sheathing members and panel members, and a third separate space between said two panel members.

5. The invention according to claim 4 and further including a resilient batt of fire-retardant insulating material substantially filling said third space.

6. The invention according to claim 5 wherein the combined thickness of said panel members is significantly less than the distance between said wooden members of the studs, said panel members extend between the web members of successive studs and the original thickness of said batt of insulating material is greater than the distance between said panel members, whereby said batt is compressed between said panel members and urges the latter outwardly to maintain the vertical marginal edges thereof in engagement with the adjacent wooden members of said studs.

7. A building wall construction comprising, in combination:

(a) an elongated top plate;

(b) an elongated bottom plate extending in spaced, horizontal, parallel relation to said top plate;

(c) a plurality of elongated studs arranged in spaced, vertical, parallel relation and affixed at their upper and lower ends to said top and bottom plates, respectively; and (d) each of said studs comprising a pair of spaced wooden members of equal length having a substantially rectangular groove centrally disposed in one face thereof extending for the entire length of said wooden members, and at least one web member having opposite, marginal edge portions secured in said grooves, thereby joining said wooden members in spaced relation, the dimensions and materials of said wooden members and said web member being such that said studs are suited for supporting loads applied at the ends;

(e) sheathing layers affixed to both sides of said stud members and extending vertically between said bottom and top plates, and horizontally between said studs to enclose the space therebetween;

(f) a pair of panel members arranged between said sheathing layers in parallel, spaced relation thereto to define first and second spaces between said panel members and said sheathing layers and a third space between said pair of panel members; and (g) a resilient batt of fire-retardant insulating material substantially filling said third space the combined thickness of said panel members is significantly less than the distance between said wooden members of the studs, said panel members extend between the web members of successive studs and the original thickness of said batt of insulating material is greater than the distance between said panel members, whereby said batt is compressed between said panel members and urges the latter outwardly to maintain the vertical marginal edges thereof in engagement with the adjacent wooden members of said studs.

* * * * *